US005566807A

United States Patent [19]

Morun

[11] Patent Number: 5,566,807

[45] Date of Patent: Oct. 22, 1996

[54] COIN ACCEPTANCE METHOD AND APPARATUS

[75] Inventor: Mark J. Morun, West Chester, Pa.

[73] Assignee: Mars Incorporated, McLean, Va.

[21] Appl. No.: 397,917

[22] Filed: Mar. 3, 1995

[51] Int. Cl.[6] ..... G07D 1/02

[52] U.S. Cl. ..... 194/217; 453/17

[58] Field of Search ..... 194/216, 217, 194/218; 453/17

[56] References Cited

U.S. PATENT DOCUMENTS

| | | | |
|---|---|---|---|
| 3,814,115 | 6/1974 | Van Acker . | |
| 3,844,297 | 10/1974 | Lautzenhiser . | |
| 3,870,137 | 3/1975 | Fougere . | |
| 4,106,610 | 8/1978 | Heiman . | |
| 4,361,218 | 11/1982 | Van Dort | 324/234 X |
| 4,367,760 | 1/1983 | Thomas et al. . | |
| 4,458,187 | 7/1984 | Heiman | 221/21 X |
| 4,628,194 | 12/1986 | Dobbins et al. | 209/534 X |
| 4,785,927 | 11/1988 | Dobbins | 194/200 |
| 5,076,441 | 12/1991 | Gerlier | 209/534 |
| 5,167,313 | 12/1992 | Dobbins et al. | 194/317 |
| 5,222,584 | 6/1993 | Zouzoulas | 194/207 |

*Primary Examiner*—F. J. Bartuska
*Attorney, Agent, or Firm*—Fish & Richardson P.C.

[57] ABSTRACT

A method and apparatus for accepting coins of denominations that have and do not have coin tubes for making change in a coin mechanism is described. One aspect of the invention concerns a method for calculating an overpay amount. The overpay amount is set to equal the value of the lowest value coin with a tube minus the value of the lowest value non-tubed coin. Thus, when the lowest value coin tube is empty a vending machine customer will be permitted to insert low value, non-tubed coins up to the overpay value to increase the likelihood of enabling a vend of an item to take place. Another aspect of the invention relates to the acceptance of high-valued, non-tubed coins. The high-value non-tubed coins are acceptable if adequate change exists in the coin tubes to payback their value plus the value of any existing credit, if their value plus any credit value is greater than the maximum vend price, and if each of the vend prices in the vending machine permit adequate change to be returned to the customer.

10 Claims, 10 Drawing Sheets

COIN ACCEPTANCE METHOD AND APPARATUS

FIELD OF THE INVENTION

The invention relates to money acceptance automatic transaction systems for dispensing products or performing services, and more specifically, to coin acceptance in coin operated vending machines.

BACKGROUND OF THE INVENTION

Consumer convenience is a major concern in using automatic transaction systems, such as vending machines. Many vending machine customers often do not have exact change, and thus the machines typically are capable of making change. However, if the vending machine coin tubes that are used to dispense change are low or empty, then deposit of exact change is often required. In such an instance, a customer may be unable to purchase an item he wanted and, correspondingly, a sale of that item may be lost.

Conventional vending machines typically have coin tubes for dispensing change corresponding to all of the denominations of coins that can be accepted by the coin validator. However, in some cases the lowest value coin denomination that can be accepted by the machine does not have a coin tube associated with it. For example, there are vending machines that accept pennies, nickels, dimes and quarters and do not contain penny coin tubes. A problem arises when nickels used for change in such an apparatus are in short supply or if the nickel coin tube is empty. In such a case, the apparatus can only make change in either limited combinations of nickels and other coins or only in dimes and quarters. Such machines often then require the deposit of exact change only from a customer, which may be displayed electronically for a customer by virtue of an "exact change" LED indicator or scrolling display on the front panel of the vending machine. The drawback of operating in such a manner is that some customers will not be able to purchase an item even though they would prefer to overpay slightly to receive it than to have a nickel or the like in change returned.

Another problem arises when a vending machine is capable of accepting high-value coins, such as dollar coins, that do not have a corresponding coin tube. In some cases, for example, if the amount of change in the coin tubes is low, the vending machine will not accept any non-tubed coin, even if it could be combined with a denomination having a coin tube to equal the price of an item for sale in the machine.

Therefore, there is a need for a coin acceptance method for a vending machine which will enable a customer to overpay slightly in order to receive a product or service. In addition, there is a need for a method for a vending machine which will enable a customer to insert a high-value, non-tubed coin into the vending machine in situations where some coin tubes are low or empty but the vend prices of items in the machine may permit the use of such a coin.

SUMMARY OF THE INVENTION

One aspect of the invention solves the first problem discussed above by providing a method for accepting coins for a vending machine having a coin mechanism that accepts and validates deposited coins and dispenses change. In particular, a coin mechanism capable of accepting coins of denominations having corresponding coin tubes and low denomination non-tubed coins first determines the value of the lowest-value non-tubed coin. Then, an overpay amount is calculated which is equal to the value of the lowest denomination coin having a coin tube minus the value of the lowest-value, non-tubed coin. The established overpay amount is used to enable a vending machine to accept coins, make change and vend a product while allowing a customer to pay slightly more than the vend price in order to receive the item.

Another aspect of the present invention primarily concerns acceptance of high-value, non-tubed coins such as, for example, U.S. dollar coins when the change making ability of the vending machine is restricted due to low or empty coin tubes. In particular, it is first determined whether an adequate supply of coins exists to make change for an input value equal to the existing credit value of already inserted coins plus the value of a high-value, non-tubed coin. If so, then it is determined if that input value is greater than the maximum vend price in the machine. If it is, then the vending machine system analyzes each of the vend prices to ensure that adequate change is available in the coin tubes for each item. If change is available for all the vend prices then acceptance of that high-value non-tubed coin is enabled. If change is not available, then acceptance of that high value, non-tubed coin will be disabled. However, if a customer inserts lower-denomination, tubed coins before inserting the high value coin, there is a possibility that the maximum vend price would be reached and/or adequate change would become available for each of the vend prices. Thus, a display could be added to the front panel of the vending machine instructing customers to first deposit lower denomination coins so as to increase the probability of coin acceptance.

The above-discussed features, as well as additional features and advantages of the present invention, will become more readily apparent by reference to the following detailed description and the accompanying drawings.

DETAILED DESCRIPTION

The coin acceptance apparatus and method of the present invention may be used for the dispensing of items including the vending of products, such as drinks, snacks, cigarettes, toiletries or tickets, and the providing of services, such as in pay telephones or turnstiles. The present invention provides a convenience over prior art systems because a customer no longer has to fail to purchase an item due to a lack of a predetermined combination of tubed coins or coins and currency. The invention is described below with reference to a vending machine which is not meant to be a limitation on the application of this invention.

Figure 1:
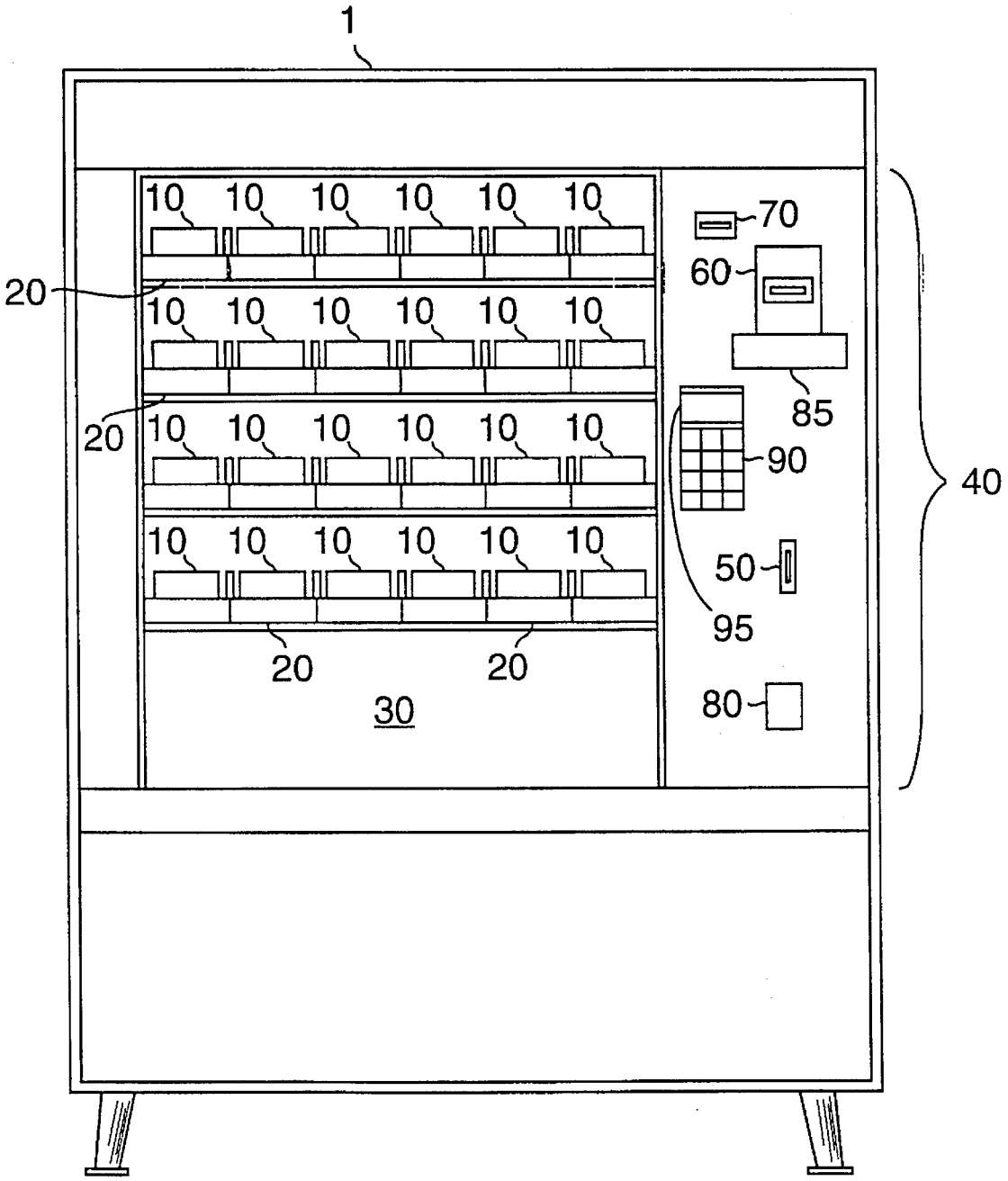
FIG. 1 PRIOR ART
FIG. 1 is a front view of a typical vending machine which can operate according to the present invention.

FIG. 1 illustrates a vending machine 1 which contains a variety of products 10 to be dispensed which are stored in an area inaccessible to customers, such as behind a glass panel. Each product 10 is retained by a product delivery apparatus 20 which is selectively actuatable to dispense the product into a delivery area 30 that is accessible to the customer. Suitable product delivery apparatus 20 include vend motors and solenoids as well as others well known in the art. Examples of such apparatus include those described in U.S. Pat. Nos. 4,458,187 and 4,785,927, assigned to the assignee of the present invention, which are hereby incorporated by reference.

A control panel 40 of the vending machine 1 contains a coin slot 50 and a banknote or bill insert slot 60 which accept currency to initiate a vend operation. The control panel 40 further contains a card acceptor 70 to enable customers to initiate a transaction with a credit or debit card. In addition, an electronic purse device in the form of a card may be inserted into the card acceptor 70 to initiate a transaction. The term "electronic purse device" is used herein to denote a token or card possessing an electronic circuit, a magnetic strip or other data storing medium or circuitry, for retaining a credit value. An electronic purse device may be in one of a variety of shapes, including a key or coin, as well as the card. Such devices may be used as currency in a variety of conventional automatic transaction systems.

A coin return 80, a bill payout recess 85 and an item selector such as a keypad 90 are also provided in the control panel 40. A display 95 on the control panel 40 may provide instructions and information to the customer. Suitable displays 95 include dot-matrix displays, selectively activatable message lights, an electronic scrolling message, or other displays capable of operating in the environmental conditions to which automatic transaction systems are typically exposed.

A customer may initiate a transaction by depositing coins or bills of particular denominations in the slots 50 or 60, respectively. The customer may also insert an electronic purse device, or a debit or credit card in the card acceptor 70 to initiate a transaction. Once sufficient payment has been deposited in the automatic transaction system 1, the customer may select a product 10 to be dispensed using the keypad 90. The corresponding product delivery apparatus 20 will then dispense the selected product 10 to the product delivery area 30 where it may be retrieved by the customer. Any resulting change from the transaction may be paid out through the coin return 80, the bill payout recess 85 or credited to an inserted electronic purse device.

Figure 2:
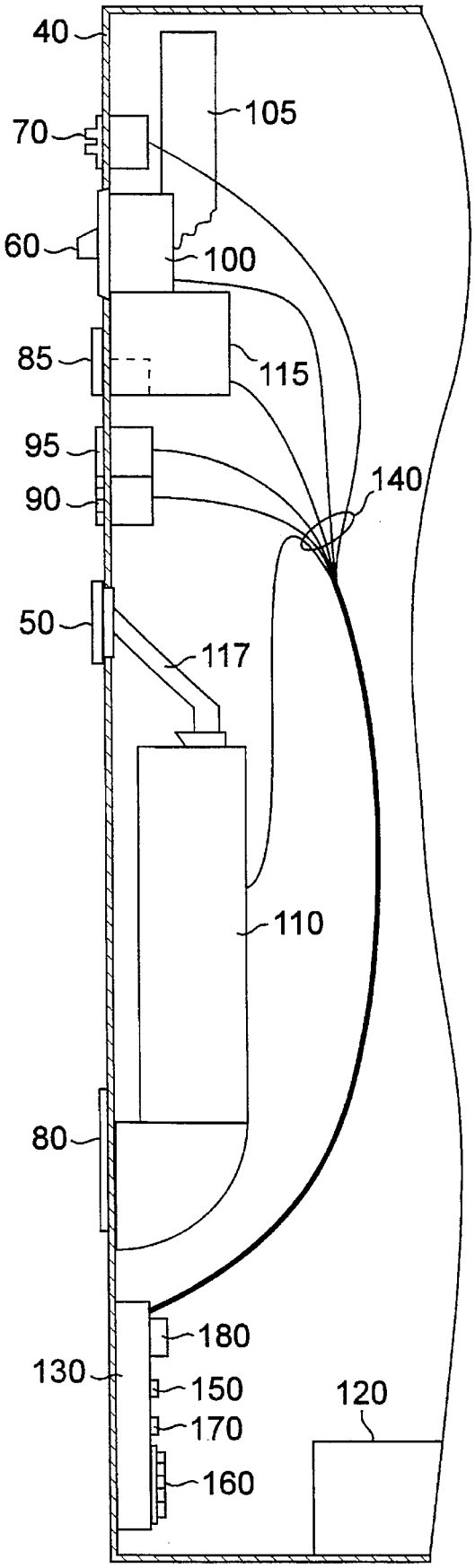
FIG. 2 PRIOR ART
FIG. 2 is a partial cut-away side view of the front panel of the vending machine of FIG. 1.

FIG. 2 is a partial cutaway side view, not drawn to scale, of the vending machine 1 of FIG. 1 showing a typical component layout along the control panel 40. Referring to FIG. 2, money acceptors, such as a bill validator 100 and a coin mechanism 110, are attached to the rear of the control panel 40 adjacent the bill insert and coin slots 60 and 50, respectively. The coin mechanism 110 is connected to the coin return 80 and to a coin passageway 117 leading to the coin slot 50. The bill validator 100 is connected to a bill stacker 105. The coin mechanism 110 and bill validator 100 are capable of discriminating coins and bills and are discussed in greater detail below with respect to FIGS. 3 and 4, respectively.

A bill escrow and payout unit 115 is positioned adjacent the bill payout recess 85 and is connected to the bill validator 100. The bill escrow and payout unit 115 is capable of dispensing bills as change through the bill payout recess 85. The bill validator 100 may divert deposited acceptable bills to the bill escrow and payout unit 115 to replenish its supply of bills for change. Suitable bill escrow and payout units 115 include those disclosed in U.S. Pat. No. 5,076,441, as well as others well-known in the art. A cash box 120 is also included in the vending machine 1.

The bill validator 100, coin mechanism 110, bill escrow and payout unit 115, card acceptor 70, keypad 90 and display 95 are connected to a vend controller 130 by communication lines 140. The controller 130 is further connected to data entry devices, such as DIP switches 150, a keypad 160, an input/output port 170, as well as a display 180 to facilitate entering and updating of operating data and servicing of the vending machine 1. A more detailed description of the controller 130 is provided below with respect to FIG. 5. The components disposed behind the control panel 40 are not accessible to customers of the vending machine 1 and may only be accessed by service personnel.

Figure 3:
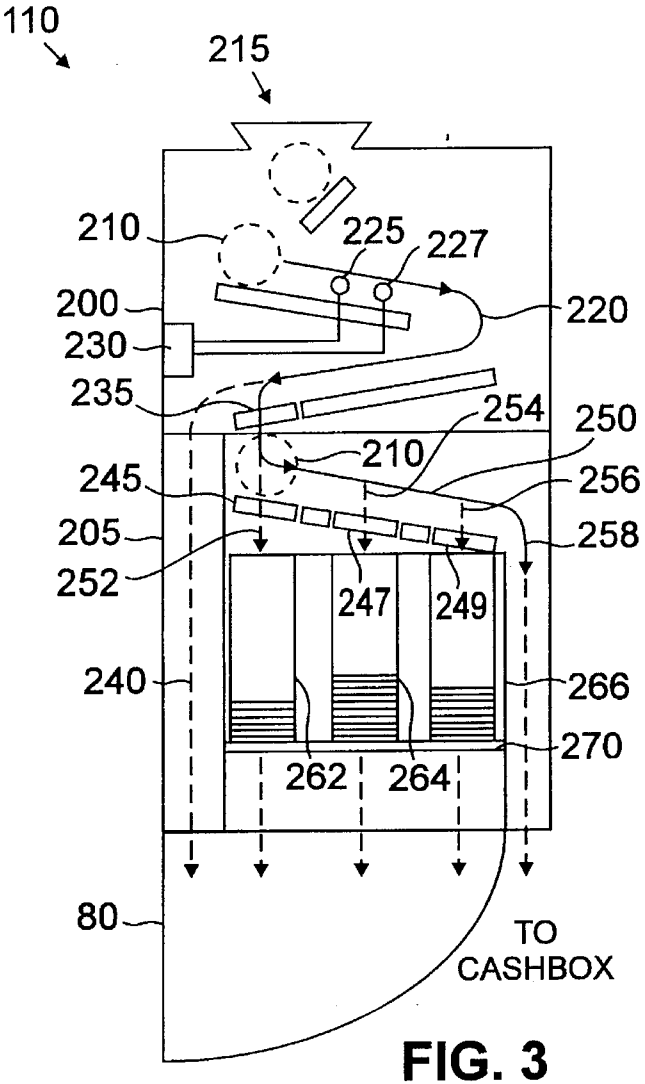
FIG. 3 PRIOR ART
FIG. 3 is a cut-away front view of a coin mechanism of the vending machine of FIG. 2.

Any coin mechanism capable of validating coins of different denominations may be used as the coin mechanism 110 in FIG. 2, and the details of one suitable coin mechanism 110 are illustrated in FIG. 3. Referring to FIG. 3, coin mechanism 110 consists of a coin validator 200 and a coin separator 205. The coin validator 200 receives inserted coins 210 through an opening 215 which is connected to the coin passageway 117 of FIG. 2. The coin 210 travels along a path 220 in the coin validator 200 past two sensors 225 and 227.

The sensors 225 and 227 generate electrical signals which are provided to a coin mechanism processor 230 such as a microprocessor or microcontroller. The processor 230 is also connected to the vend controller 130 via communications lines 140, shown in FIG. 2. The electrical signals generated by the sensors 225 and 227 contain information corresponding to the measured characteristics of the coin, such as the coin's diameter, thickness, metal content and electromagnetic properties. Based on these electrical signals, the processor 230 is able to discriminate whether the coin is acceptable, and if so, the denomination of the coin 210. The coin mechanism processor 230 provides information concerning the denomination of accepted coins to the controller 130 over the communication lines 140 of FIG. 2. Suitable arrangements for sensors 225 and 227 include those described in U.S. Pat. Nos. 3,870,137 and 4,361,218, assigned to the assignee of the present invention, which are hereby incorporated by reference.

If the coin 210 is unacceptable, the processor 230 controls a gate 235 to direct the unacceptable coin 210 to a reject chute 240. The reject chute 240 is connected to the coin return 80 of FIGS. 1 and 2. In the alternative, acceptable coins 210 are directed to the coin separator 205 by the gate 235. The coin separator 205 may have a number of gates 245, 247, 249, also controlled by signals from the processor 230 for diverting the coin 210 from a main path 250. The coin 210 may be diverted into respective paths 252, 254 and 256, or the coin 210 may be allowed to proceed along path 250 to a path 258 leading to the cash box 120 shown in FIG. 2.

Each of the paths 252, 254 and 256 leads to a respective one of three coin tubes or containers 262, 264 and 266. Each of these coin tubes 262–266 is arranged to store a vertical stack of coins of a particular denomination. For example, the coin tube 262 may contain nickels, the coin tube 264 may contain dimes, and the coin tube 266 may contain quarters. Although only three containers are shown, any number may be provided. Further, the coin mechanism 110 may utilize passive routing techniques, such as those well known in the vending machine art, instead of the gates 245–249 for diverting the coin 210 from the path 250. Examples of suitable alternative configurations for the coin separator 205 are described in U.S. Pat. Nos. 3,844,297 and 4,106,610, assigned to the assignee of the present invention, which are hereby incorporated by reference.

A dispenser 270 associated with the coin tubes 262–266 is operable to dispense coins from the containers when change is to be given to a customer by the coin mechanism 110. The dispensed coins are delivered to a coin return 80 for collection. Suitable dispensers 270 include those described in U.S. Pat. Nos. 3,814,115 and 4,367,760, assigned to the assignee of the present invention, which are hereby incorporated by reference. An alternative configuration may use a coin mechanism 110 that does not payout change. In such a configuration, a separate pre-loaded coin payout device, such as those well known in the gaming machine art, may be utilized to payout change.

Any bill validator that is capable of discriminating unique characteristics of bill denominations may be used as the bill validator 100 of FIG. 2. Suitable bill validators 100 include those described in U.S. Pat. Nos. 4,628,194 and 5,222,584, which are also assigned to the assignee of the present invention and hereby incorporated by reference.

Figure 4:
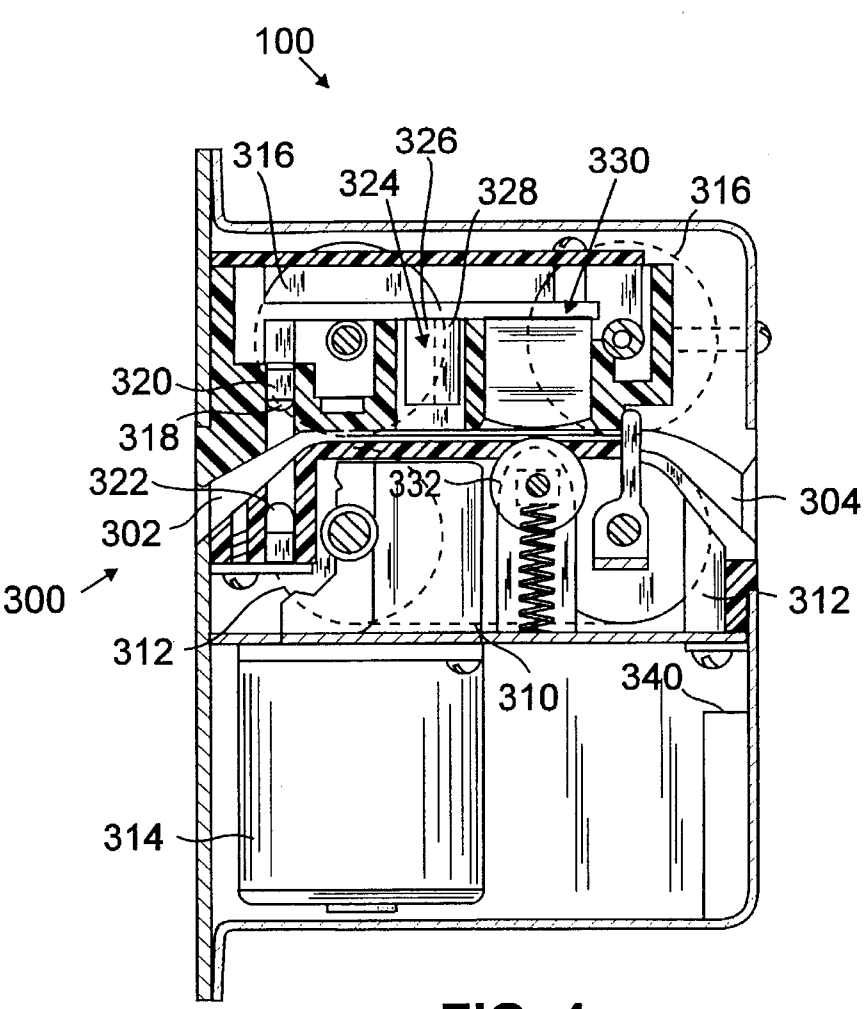
FIG. 4 PRIOR ART
FIG. 4 is a cut-away side view of a bill validator of the vending machine of FIG. 2.

FIG. 4 depicts the details of one suitable bill validator 100. Referring to FIG. 4, the bill validator 100 contains a bill passageway 300 having an entry 302 and an exit 304. Disposed on either side of the bill passageway 300 are two continuous track belts 310 which are supported by parallel rollers 312. The rollers are operably connected via a series of gears (not shown) to a motor 314. The motor controlled belts 310 act to advance a bill through the passageway 300 in a forward direction (from left to right in FIG. 4). The motor 314 is reversible so that it can drive belts 310 in an opposite direction, reversing the direction of travel of the bill. Positioned directly above each belt 310 is a set of wheels 316 which further assist the inserted bill in advancing through the passageway 300.

Adjacent the entry 302 is an optical sensor 318 consisting of an optical transmitter 320 and an optical receiver 322 disposed on opposite sides of the bill passageway 300. Interruption of a light beam travelling from the transmitter 320 to the receiver 322 will cause the receiver to generate a signal indicating the presence of a bill in the passageway entry 302. This signal causes the motor 314 to drive the rollers 312 which cause track belts 310 to move and to grip an inserted bill. The bill is then advanced past the sensors 324 and 330, as explained below.

A reflective sensor 324 is located directly above the approximate center of the passageway 300 and consists of a second optical transmitter 326 and a second optical receiver 328 which are both located in close proximity on the same side of the passageway 300. The reflective sensor 324 is positioned to detect and respond to the presence or absence of optical information on a bill positioned in the passageway 300. If the surface of the bill directly beneath the reflective sensor 324 is relatively reflective, such as the unprinted areas of U.S. banknotes, then the light emitted by the transmitter 326 will be reflected by the bill surface onto the receiver 328. Conversely, if the surface is not reflective then little light will be reflected onto the receiver 328. Suitable optical sensors for sensing U.S. banknotes include red, green and infra-red light sensors. In an alternative embodiment, an optical sensor may comprise a transmitter and receiver disposed on opposite sides of the passageway 300 to obtain information concerning the light transmission characteristics of inserted bills.

Adjacent the reflective sensor 324 is a magnetic sensor 330, which generates an electric signal in response to the presence of magnetic information on the surface of the bill beneath the sensor 330. Positioned beneath the magnetic sensor 330 is a pinch wheel 332 which is spring biased against the magnetic sensor 330 to press the inserted bill against the magnetic sensor 330 ensuring accurate detection of magnetic information on the bill.

The reflective sensor 324 and the magnetic sensor 330 provide electrical signals to a bill validator processor 340, such as a microprocessor or microcontroller. The electrical signals correspond to optical and magnetic information detected from the bill. Based on these electrical signals, the processor 340 is able to discriminate whether the bill is genuine, and if so, the denomination of the bill. If a bill is unacceptable, the motor 314 is reversed and the bill is returned to the customer. Otherwise, an accepted bill is diverted to the bill stacker 105 or to the bill escrow and payout unit 115. The processor 340 provides denomination information to the vend controller 130 over the communication lines 140 of FIG. 2. An alternative configuration of the present invention may use a bill validator 100 that only stacks accepted bills in the stacker 105 or provides such bills to the cash box 120. In such a system, a separate pre-loaded bill payout device controlled by the vend controller 130, may be utilized to payout change.

Figure 5:
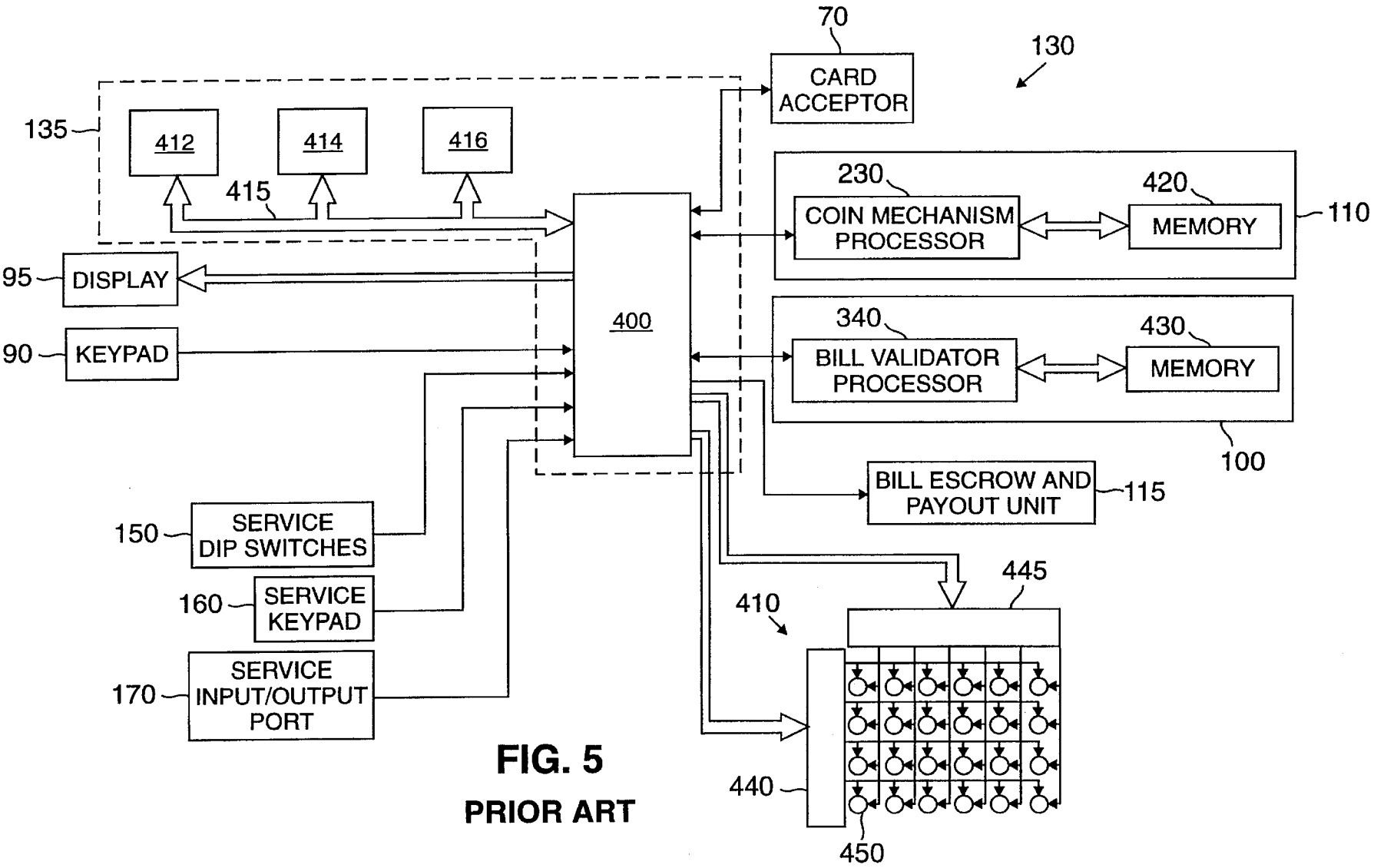
FIG. 5 PRIOR ART
FIG. 5 is a schematic block diagram of electrical components of the vending machine of FIGS. 1 and 2.

FIG. 5 is a simplified block diagram showing electrical connection of elements of one suitable vend controller 130 having the various system components shown in FIG. 2. Similar components in FIGS. 2 and 5 are like numbered for clarity, for example, the display 100 and the card acceptor 70. In FIG. 5, the components contained in the transaction controller 130 of FIG. 2 are depicted within a dashed outline 135 and include a processor, such as a microprocessor 400, which is connected to memories 412, 414 and 416 via data and address lines 415. Alternative suitable processors for the controller 130 include microcontrollers, programmable logic arrays and application specific integrated circuits.

The memories 412, 414 and 416 may be random-access memory (RAM), read-only memory (ROM) and electronically erasable-programmable read-only memory (EEPROM), respectively. These memories may reside in one or more integrated circuit chips. It should be understood that the three memories 412, 414 and 416 are shown herein for exemplary purposes only, and that the present invention may include any number of application suitable memory types.

The microprocessor 400 communicates with a vend dispensing circuit 410, the service input/output port 170, the card acceptor 70, the bill payout device 115, and the processors 230 and 340 of the coin mechanism 110 and bill validator 100, respectively. The processors 230 and 340 are also shown connected to corresponding memories 420 and 430 within the coin mechanism 110 and bill validator 100. The memories 420 and 430 may be ROM, RAM or EEPROM type memories or a combination of memory types suitable to perform money accepting operations. The microprocessor 400 also receives signals from the keypad 90, the service switches 150 and the service keypad 160. In addition, the microprocessor 400 provides display information to the display 95.

The microprocessor 400 executes program code stored in memory, such as the ROM memory 414, to control the operations of the vending machine 1. Pricing information and other service data may be retained in the EEPROM memory 416. Intermediate or temporary data generated by the microprocessor 400 during a transaction may be retained in the RAM memory 412.

The processor 230 controls the operations of the coin mechanism 110 in the acceptance and validation testing of coins, and the processor 340 controls similar operations of the bill validator 100. During validation testing of a coin, the processor 230 receives information signals generated by the sensors 225 and 227 of FIG. 3. The processor 230 processes the received information by comparing it with acceptance criteria stored in the memory 420. In a similar manner, the bill validator processor 340 processes received information signals from the sensors 318, 324 and 330, shown in FIG. 4, by comparing it with bill acceptance criteria stored in the memory 430. The bill and coin acceptance criteria may consist of ranges of values corresponding to properties of genuine bill or coin denominations. One suitable arrangement of acceptance criteria is described in U.S. Pat. No. 5,167,313 which is assigned to the assignee of the present invention.

The processors 230 and 340 provide data concerning the denominations of accepted coins and bills to the vend controller microprocessor 400. Based on this data, the microprocessor 400 computes the corresponding credit value and controls the dispensing of a product by the vend dispensing circuit 410 if sufficient credit is available. The vend dispensing circuit 410 correspond to a vend dispensing circuits well known in the art, including the circuit described in U.S. Pat. No. 4,785,927.

A typical vend dispensing circuit 410 includes a row selector 440 and a column selector 445 connected to each one of a plurality of vend motors 450. Each vend motor 450 is disposed in a respective one of the vend delivery apparatus 20, shown in FIG. 1. A product will be dispensed by the operation of the corresponding vend motor 450 that receives select signals simultaneously from both the row and column selectors 440 and 445. Each selector 440 and 445 is operable to select only one row and column at a time. The microprocessor 400 controls the row and column selectors 440 and 445 to select a vend motor 450 in a vend delivery apparatus 20 to dispense a product based on the selection made by the customer via the keypad 90.

In determining the available credit for a transaction, the microprocessor 400 converts the value of genuine deposited coins and bills into a credit value. Operating program and data changes may be entered or updated by a service person having access to the rear of the control panel 40. The vending machine operating program may be updated or entered using data entry devices, such as the service switches 150, the service keypad 160 or input-output port 170 which permits uploading of the rate by use of a connected portable terminal. Although the vending machine 1 is shown with three data entry devices any one or combination of these three devices may be used in a system 1 according to the present invention. In addition, program and data changes may be entered by use of other data entry devices, such as an infra-red or other type optical link, or by a bar code reader with suitable prepared bar code labels, or a remote communication link including a modem link.

The respective coin mechanism 110 or bill validator 100 discriminates a deposited bill or coin to determine whether it is a valid acceptable denomination. Alternatively, the card acceptor 70, shown in FIG. 2, will evaluate any inserted electronic purse device, or credit or debit card to determine if it may be used in vending machine 1. Invalid money, cards or devices will be rejected and returned to the customer. The detected denomination value of the deposited acceptable bill or coin, or the credit amount on the inserted electronic purse device are provided by the respective money acceptor to the microprocessor 400 of FIG. 5.

If an electronic purse device has been inserted into the card acceptor 70, the cost value is debited from the card. Then, the selected item is dispensed. If change has to be given, it may be dispensed in coins by the coin mechanism 110 and/or bills by the bill escrow and payout unit 115 of FIG. 2. Change may also be applied as credit to an electronic purse device.

If the credit value is less than the item cost, the microprocessor 400 may cause the display 95 to display a message indicating that additional currency needs to be inserted to purchase the selected item. After displaying the message, it is determined if additional currency has been inserted.

Figure 6:
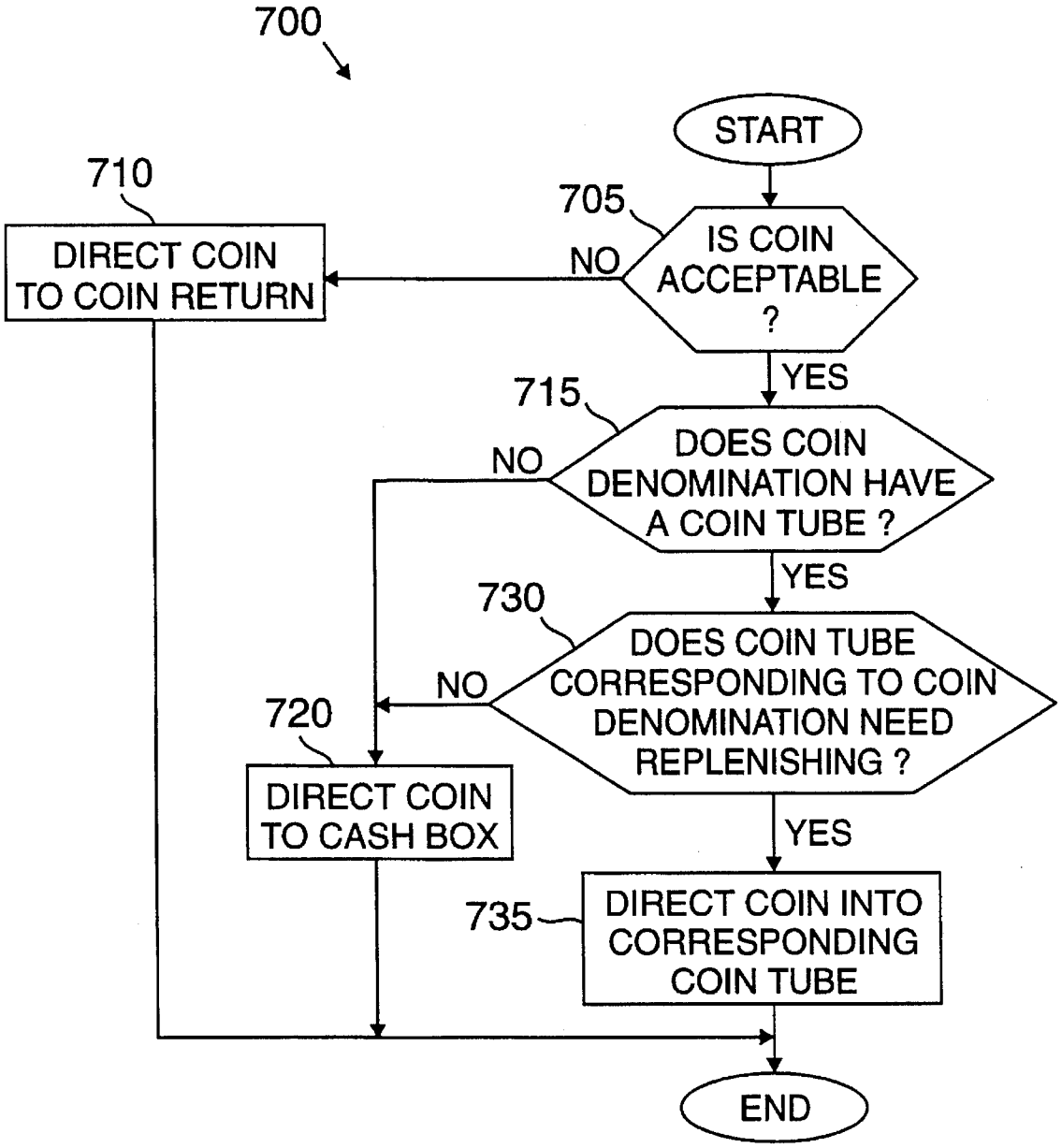
FIG. 6 PRIOR ART
FIG. 6 is flow chart showing a coin routing method which may suitably be employed by the coin mechanism of FIG. 3.

The coin mechanism 110 utilizes replenishable coin tubes 262–266, shown in FIG. 3, so that change may be paid from coins that were deposited in previous transactions. The processor 230, shown in FIG. 3, controls the routing of deposited coins through the coin mechanism 110 to the coin tubes 262–266 or the cashbox 120 based on a routing method, such as the routing method 700 of FIG. 6. Referring to FIG. 6, in step 705, the processor 230 determines if a deposited coin is an acceptable currency denomination. If the deposited coin is not acceptable, the method 700 proceeds to step 710 where the processor 230 causes the coin mechanism gate 235, shown in FIG. 3, to divert the coin to the reject chute 240 leading to the coin return 80. However, if the coin is identified as acceptable in step 705, the processor 230 operates the gate 235 to direct the coin to the coin separator 205.

Then, in step 715, if the coin is of a denomination having a coin tube, the method 700 proceeds to step 720. In step 720, the processor 230 causes the coin separator gates 245–249, shown in FIG. 3, to route the coin to the path 258 leading to the cash box 120. In the alternative, if in step 715, the acceptable coin corresponds to a denomination that has a coin tube, the method 700 proceeds to step 730. In step 730, the processor 230 determines if a coin tube 262, 264 or 266 corresponding to the coin's denomination needs replenishing. If so, the coin is directed to a coin tube, if not then the coin is directed to the cash box 120.

The processor 230 may keep a running total of the coins maintained in the coin tubes 262–266, or it may utilize sensors or other means to determine whether a tube needs replenishing. If no corresponding coin tube exists for that coin denomination, or if the corresponding coin tube does not need replenishing, the method 700 proceeds to step 720 where the coin is routed to the cash box 120. However, if the corresponding coin tube needs replenishing, the method proceeds to step 735 where the processor 230 operates one of the gates 262, 264 or 266 to route the coin to the proper coin tube.

The bill validator 100 of FIG. 2 operates in a similar manner to the coin mechanism 110 in that the processor 340, shown in FIG. 4, relies on information contained in the signals generated by the sensors 324 and 330, also shown in FIG. 4, to determine the validity of an inserted bill. If a bill is unacceptable, the processor 340 reverses the motor 314 and returns the bill to the customer. However, if the bill is genuine, the bill is routed by a suitable bill diverting device to the bill stacker 105 or to the bill escrow and payout unit 115. Particular currency denominations that may be used for change may be routed to the bill escrow and payout unit.

Several problems arise in prior art vending machines that have coin mechanisms capable of accepting coins which do not have corresponding coin tubes. For example, the coin mechanism 110 shown in FIG. 3 accepts nickels, dimes and quarters and contains coin tubes 262, 264 and 266 to store coins of those denominations. However, if pennies and dollar coins are also acceptable, then the vending machine system must determine what steps to take if, for example, there are no nickels or dimes in the coin tubes and a customer wishes to insert a non-tubed coin, such as pennies into the vending machine. Another problem concerns how to address the situation where the coin tubes are low or empty and a customer wishes to insert a high-value, non-tubed coin such as a dollar coin. Some prior art systems responded to the situations outlined above by refusing to accept any non-tubed coin if, for example, the lowest denomination coin tube is below some predetermined level or value, or is empty. One disadvantage of operating in such a manner is that a customer will be prohibited from acquiring a desired item if she lacks exact change. Another disadvantage is that the customer may have an exact change combination consisting of a high-value, non-tubed coin plus a tubed coin, but will be unable to acquire the item because the vending machine will not accept the high-value, non-tubed coin. For example, if the nickel coin tube is empty, a prior art vending machine operating in the above-described manner would refuse to accept a one-dollar, non-tubed coin even if the vend price for an item is $1.25, and the customer has quarter and dollar coins. The present invention solves these problems, as described below.

Figure 7:
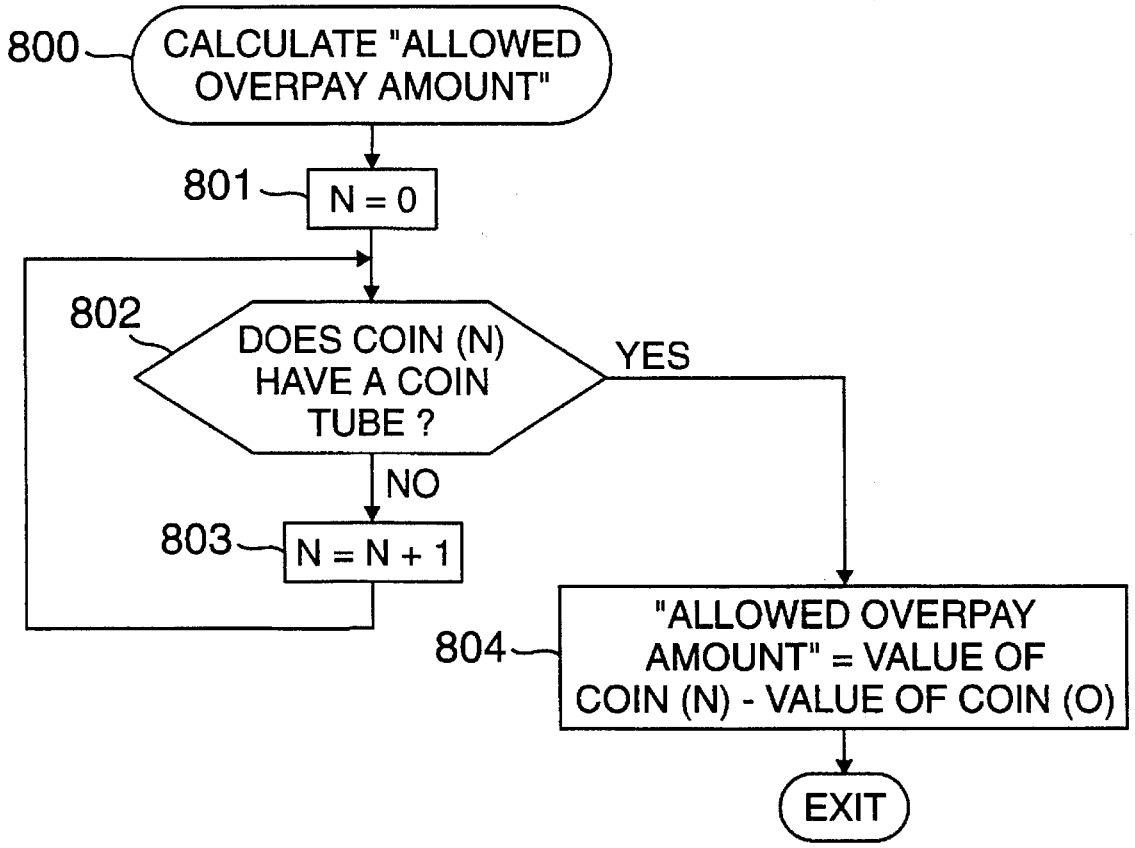
FIG. 7 illustrates a method for calculating an overpay amount according to the present invention.

FIG. 7 is a flowchart 800 illustrating the calculation of an overpay amount for a vending machine 1 which accepts coins having denominations that correspond to coin tubes and accepts non-tubed coins. This routine is run by the coin mechanism processor 230 or the vending machine controller processor 400 only once to fit the configuration of coin tubes and acceptable non-tubed coins for a particular vending machine. Referring to FIG. 7, at step 801, a variable n is set to 0. At step 802, a determination is made whether or not a coin of type n has a coin tube. If not, the count n is incremented by one in step 803, and the next acceptable coin denomination is tested in step 802. For example, coin(0) may correspond to pennies for which no coin tubes exist, whereas coin(1) may correspond to nickels for which a coin tube is available in the coin mechanism. Once the lowest denomination acceptable coin having a coin tube is found, the overpay amount is calculated in step 804. The overpay amount is set to equal the value of the lowest denomination coin that has a coin tube minus the value of the lowest non-tubed coin. For example, if the lowest value coin having a coin tube is a dime, and pennies and nickels are also acceptable, then the overpay amount would equal nine cents (ten cents minus one cent is nine cents). Thus, if there are no dimes in the coin tubes, a customer would be permitted to insert one nickel and four pennies before the vending machine would disable acceptance of the next penny or nickel. This calculated overpay amount is used to enable a vending machine to accept coins, make change and vend a product while allowing a customer to slightly overpay so that she will still receive the desired item. This technique is especially beneficial when used in combination with the methods described below.

Figure 8:
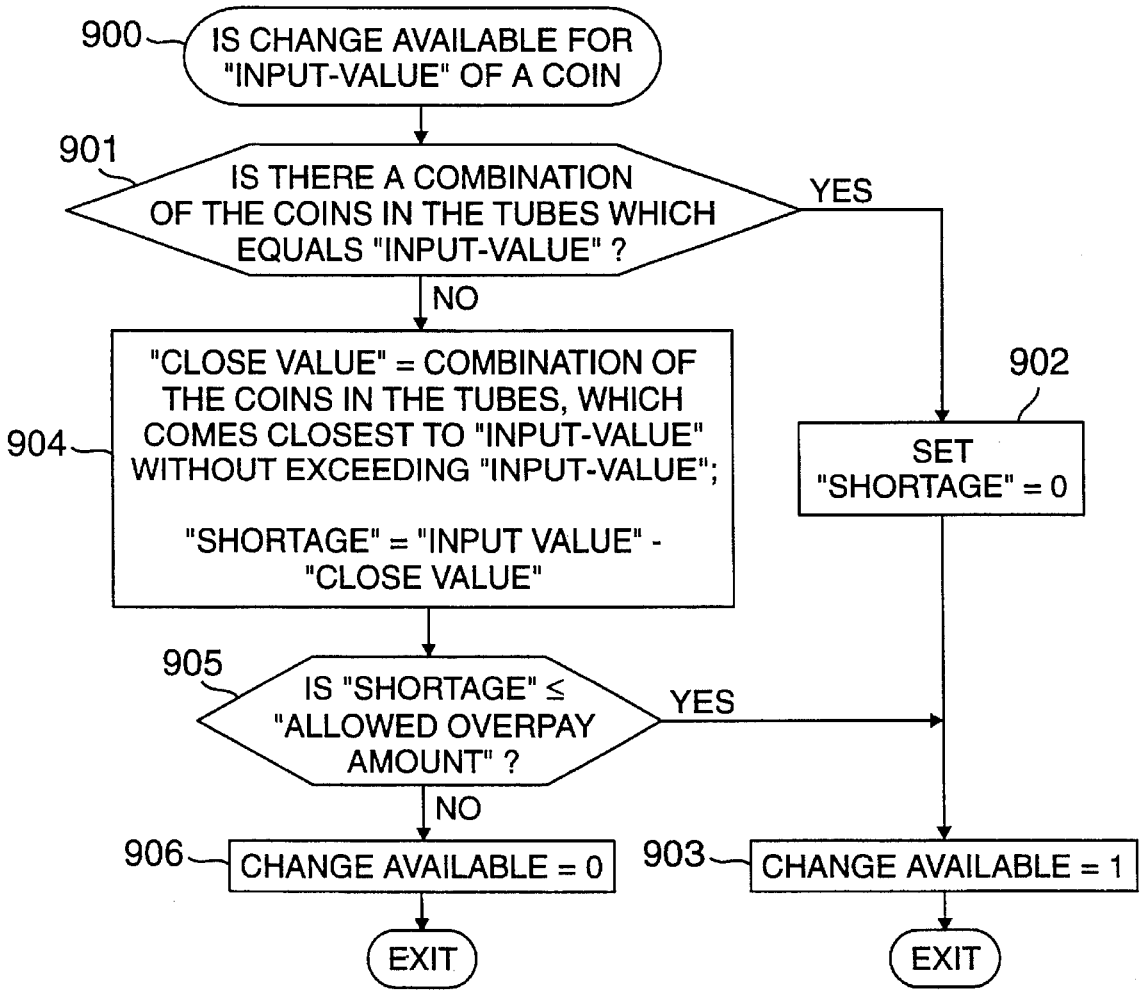
FIG. 8 is a flowchart of a technique for determining if an adequate amount of change is available in the coin tubes.

FIG. 8 illustrates a method 900 for determining if change is available for a given value of acceptable coin. This routine is run by the coin mechanism processor 230 or the vend controller processor 400 each time the vending machine changes state. For example, if a nickel was last inserted and a credit given to a customer towards the price of an item, or a vend has just occurred, a determination is made to see if change is available for each type of coin that the coin mechanism is capable of accepting. If change is available, then for the given value coin the "change available" variable is set equal to 1, however, if change is not available then the "change available" variable is set to zero. The routine of FIG. 8 is utilized in the technique for determining if a vending machine should accept deposited coins which is shown in FIGS. 10A and 10B, and is described in detail below.

Referring again to FIG. 8, in step 901, the coin mechanism microprocessor determines whether there exists a combination of coins in the coin tubes that equals an "input value". If such a combination exits then at step 902 the variable "shortage" is set to zero and at step 903 the variable "change available" is set to 1, indicating that change is available. If no such combination of coins exists, then a "close value" variable is calculated in step 904, which is equal to the value of coins in the tubes that is closest to the input value without exceeding it. In step 904, the variable "shortage" is also set equal to the "input value" minus the "close value". Next, in step 905, the shortage value is checked to see if it is less than or equal to the overpay amount which was previously calculated, as described above with respect to FIG. 7, and which has been stored in that vending machine's controller or coin mechanism. If the "shortage" is less than or equal to the overpay amount, then the variable "change available" is set to 1, but if it is not then "change available" is set to zero.

Figure 9:
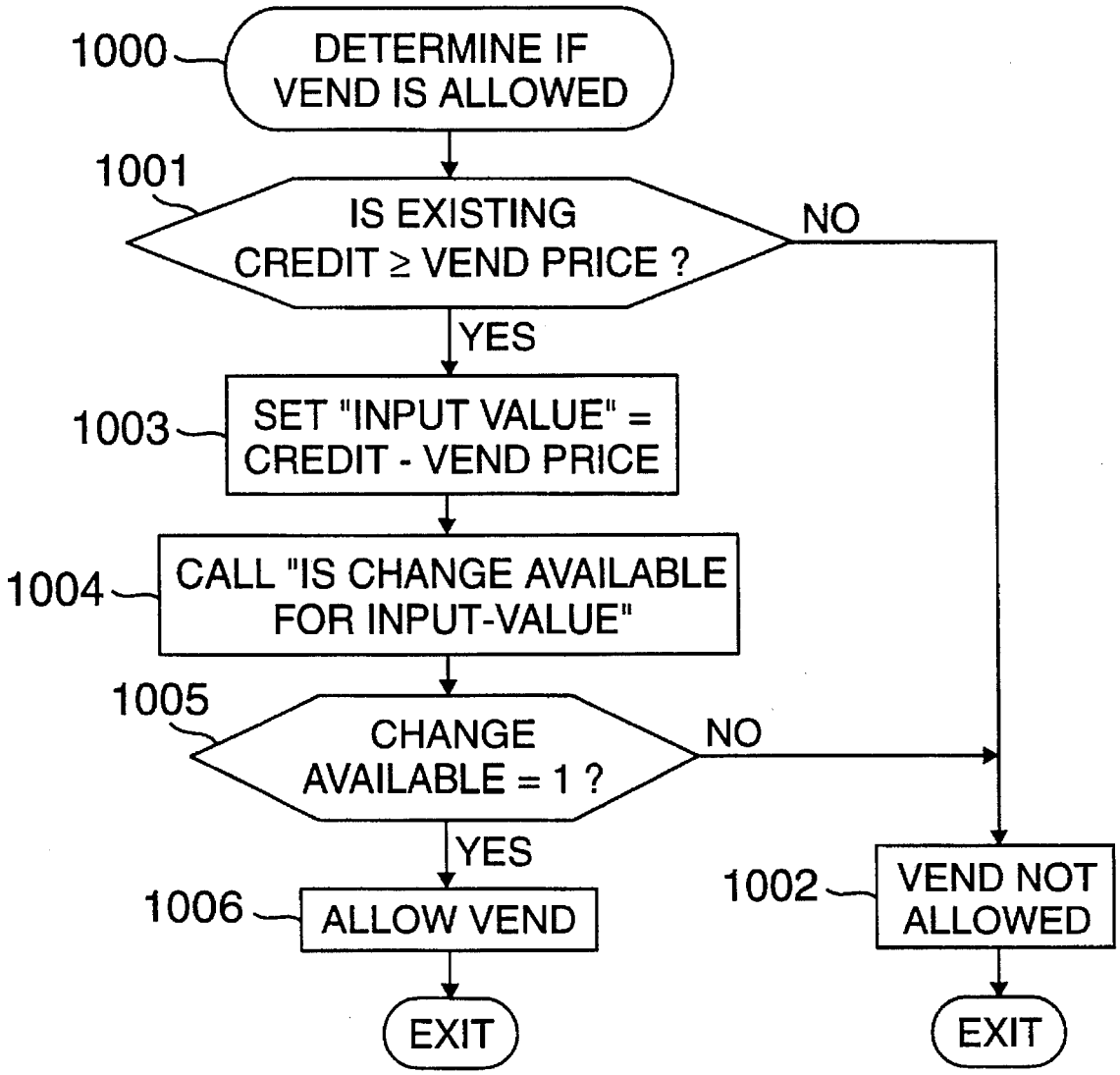
FIG. 9 is a flowchart of a technique for determining if a vend should be permitted.

FIG. 9 is a flowchart illustrating a method 1000 for determining if a vend should be allowed. This routine is run when a customer operates a selection switch after having deposited some combination of money into the vending machine. In step 1001 the credit value of accepted coins is checked to see if it is greater than or equal to the vend price for a selected item. If not, then the vend is blocked in step 1002. If the credit value is greater or equal to a vend price, then in step 1003 the variable "input price" is set equal to the existing credit value minus the vend price. Next, in step 1004 the method for determining if change is available of FIG. 8 is used to determine if change is available. Next, in step 1005 if the variable "change available" equals 1, then change is available and the vend is allowed to proceed in step 1006, otherwise the vend is blocked in step 1002.

Figure 10A:
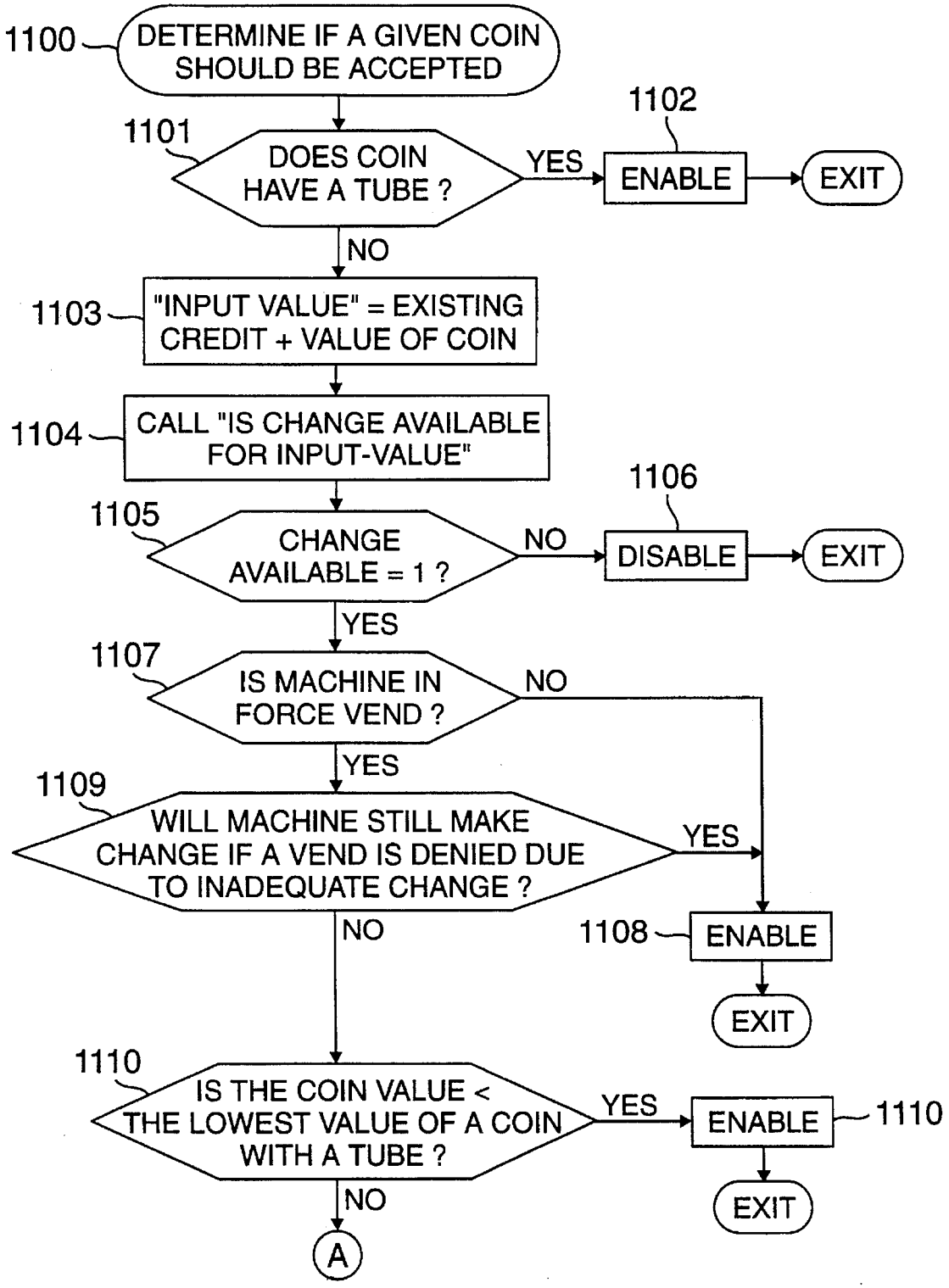
FIGS. 10A and 10B together form a flowchart illustrating a method according to the invention for determining if a given denomination of coin should be accepted.
Figure 10B:
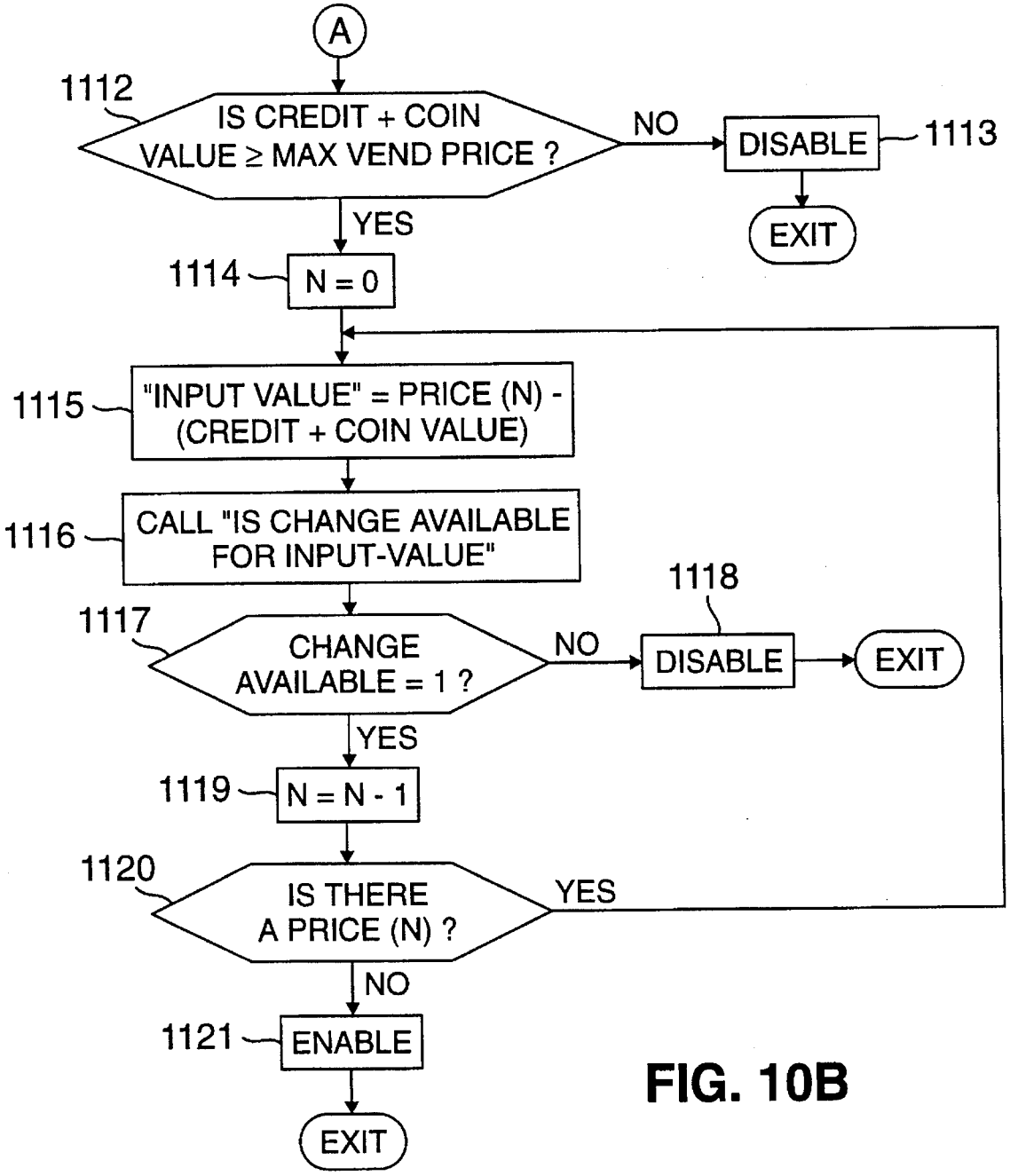

FIGS. 10A and 10B illustrate a method 1100 for determining if a coin of a given denomination should be accepted. The method of FIGS. 10A and 10B is practiced for each denomination of acceptable coin each time the state of the vending machine changes. This occurs, for example, after a vend, after a coin acceptance and validation and after a coin tube is replenished.

Referring to FIG. 10A, in step 1101 if a coin type has a coin tube then acceptance is automatically enabled in step 1102. For non-tubed coin types, in step 1103 the variable "input value" is set equal to the existing credit value plus the value of the non-tubed coin. Next, in step 1104 the technique of FIG. 8 is used to determine if change is available. In step 1105, if "change available" does not equal 1, then in step 1106 acceptance of that non-tubed coin is disabled, and if a customer attempts to use such a coin it will be returned. However, if "change available" does equal 1, then in step 1107 the vending machine is checked to see if it is in a "force vend" mode.

A "force vend" mode of a vending machine is utilized in situations where a customer deposits a high-value, non-tubed coin and attempts to have change returned before making an item selection. The vending machine controller will not make change in such a situation, but will instruct the customer via a display to make a selection or to deposit more money to increase the credit value towards the purchase price of a vend item. Thus, referring to FIG. 10A, if the machine is not in "force vend" mode, acceptance of a non-tubed coin is enabled in step 1108. However, when the vending machine is in "force vend" mode, in step 1109 if the system has been configured to pay back change when a vend is denied due to inadequate change then acceptance of that non-tubed coin is enabled in step 1108. If not, then the non-tubed input coin value is checked to see if it is less than the lowest denomination coin tube in step 1110 (such as a penny). If so, then acceptance of the coin type is enabled in step 1111. If not, then in step 1112 of FIG. 10B, the credit value plus the non-tubed coin value is checked to see if it is greater or equal to the maximum vend price in the vending machine. If not, then in step 1113 acceptance of that coin type is disabled.

If the credit value plus the value of the non-tubed coin is greater than or equal to the maximum vend price, then a determination must be made to ensure that adequate change can be returned to the customer for all possible vend prices in the machine. Thus, steps 1114 through 1120 of FIG. 10B are followed to check all of the vend prices. In particular, a count "n" is set to zero at step 1114. Next, at step 1115, the input value is set equal to the first price (corresponding to price(0)) minus the sum of the credit value plus the coin value. Next, in step 1116, the method of FIG. 8 is used to calculate the variable "change available". Then, in step 1117 if "change available" does not equal 1, then coin acceptance is disabled in step 1118. However, if "change available" does equal 1, then n is incremented, and a determination of whether there is another item price in the vending machine is made at step 1120. If so, then the next item price (price (n+1)) is checked at step 1115. In this manner the value of the inserted, non-tubed coin is checked against all of the prices in the vending machine for all possible item selections to ensure that adequate change can be made for the customer if needed. If change cannot be made for any possible selection at any item price, then the acceptance of that non-tubed coin will be disabled in step 1118. However, if after checking all possible item prices in the vending machine there exists adequate change making capability, then acceptance of that non-tubed coin will be enabled in step 1121. The phrase "adequate change making capability" is used in this context to mean that either exact change can be made, or change can be made up to a value that is less than or equal to the "overpay value". As explained above, the overpay value may be calculated as described with reference to FIG. 7, but it may also be preset into the vending machine for any value deemed acceptable. For example, an overpay amount of five cents or ten cents may be acceptable for a vending machine containing items of relatively high value, for example, vend prices ranging from $1.20 to $1.50. This is true when a determination has been made, for example, that customers depositing $1.25 would prefer to receive the item priced at $1.20 and lose a nickel in change when the nickel coin tube is empty.

The method of FIGS. 10A and 10B requires that adequate change is available to payback any existing credit plus the addition of the next acceptable coin (required should a vend fail), and further determines the acceptability of high-value, non-tubed coins based on the vend prices in the machine. As long as the existing credit plus the value of a high-value, non-tubed coin is less than the maximum vend price in the machine a non-tubed coin of that denomination will not be accepted. However, if acceptance of that coin will make the credit value greater or equal to the maximum vend price, then the system will analyze all of the other vend prices to ensure that adequate change is available for each price before enabling acceptance of that coin. If change is not available for one or more choices, then acceptance of the high-value, non-tubed coin is disabled. However, if a customer inserts lower-denomination coins first having coin tubes before inserting the high value coin, there is a strong possibility that the maximum vend price would be reached and/or adequate change would become available for each of the vend prices. Thus, a display could be added to the front panel of the vending machine instructing customers to deposit lower denomination coins first to increase the probability of accepting non-tubed high-value coins.

As can be appreciated, the technique of FIGS. 10A and 10B would require a large amount of processing power to check the acceptability for all of the possible combinations of coins having coin tubes, non-tubed coins, item vend prices and availability of coins in the tubes to make change. In order to speed up processing in vending machines having multiple vend prices, a table could be generated and stored in memory so that each vend price is stored once. Thus, the vending system can perform the calculations once for each vend price rather than for each possible product selection. If a particular vending system cannot store all of the vend prices then the acceptance of high-valued, non-tubed coins would be disabled.

In an alternative embodiment, the credit values of deposited money in the present invention may be performed by the controllers of the currency acceptors employed in the transaction system, such as the processors 230 and 340 in the coin mechanism 110 and bill validator 100, respectively. In such an embodiment, the processors 230 and 340 would provide corresponding credit values to the vend controller microprocessor 400. The credit values may be provided to the microprocessor 400 for each accepted denomination separately or in a summed aggregate manner. Thus, the microprocessor 400 would determine the acceptability of coins to be inserted in the manner described above, and may also take other money acceptance data from the other money acceptors into consideration.

In another alternative embodiment, the control operations performed by the vend controller microprocessor 400 described above with respect to FIGS. 5–6 may alternatively be performed by a money acceptor controller, such as the coin mechanism processor 230. For example, such a coin mechanism processor would receive the necessary information from the other money acceptors to determine the credit value of the deposited coins, bills and electronic purse devices. The coin mechanism processor would then provide the credit value and change data to the vend controller which would provide the necessary commands to vend the selected item if a vend has been allowed, as described above with respect to FIG. 9.

Alternatively, such a coin mechanism processor may determine if sufficient credit has been entered and if change is available, and then generate a vend signal to the vend controller. The vend signal indicates that sufficient credit has been entered, and that the vend controller should dispense a selected item. Such a coin mechanism may be used in a transaction system employing an industry standard vending machine interface, such as the "Single Price" or "4 Price" interfaces or the "Executive interface". These standard interfaces facilitate the use of vend controllers of limited computational abilities. Therefore, a system according to the present invention may be constructed using readily available components and interfaces with a suitably modified vend or currency acceptor controller.

Although several embodiments of the vending machine apparatus and method have been described above, it would be readily understood by those having ordinary skill in the art that many modifications are possible in the described embodiments without departing from the teachings of the present invention. All such modifications are intended to be encompassed by the claimed invention. For example, although the vending machine 1 of FIGS. 1 and 2 has three money acceptors, i.e., a bill validator 100, a coin mechanism 110, and a card acceptor 70, any number or combination of money acceptors that are capable of validating any number of different monies may be employed in a system according to the present invention.

I claim:

1. A method for accepting coins in a vending machine having a coin mechanism for validating deposited coins and for giving change, wherein the coin mechanism is capable of accepting combinations of coins of denominations having corresponding coin tubes and low denomination non-tubed coins, comprising:

generating a non-tube value equal to the lowest denomination non-tube coin;

calculating an overpay amount in the coin mechanism equal to the value of the lowest value denomination coin having a coin tube minus the non-tube value;

calculating a credit amount corresponding to the accumulated value of the coins inserted;

calculating a change value equal to the sum of a combination of coins available in the coin tubes that is closest to the value of an inserted, without exceeding the value of the coin; and accepting the coin if the difference between the change value and the value of the coin is less than or equal to the overpay amount.

2. The method of claim 1, further comprising:

generating a vend signal if the credit amount is equal to a vend price.

3. The method of claim 1, further comprising:

generating a vend signal if the credit amount is greater than or equal to a vend price, and if there is a combination of coins in the coin tubes of a value equal to or less than the overpay amount to provide adequate change.

4. A method for determining if a genuine non-tubed coin should be accepted by a coin mechanism of a vending machine that is in force vend mode, comprising:

setting an overlay amount;

calculating a credit value equal to the value of already deposited coins;

calculating an input value which is equal to the credit value plus the non-tube coin value;

generating a first signal if the input value minus a combination of coins in the tubes having a value closest to the input value is less than or equal to the overpay amount;

generating a second signal if the input value is greater than or equal to the maximum vend price and if adequate change exists to pay back coins for each vend selection in the vending machine; and enabling the acceptance of the non-tubed coin if both the first and second signals are generated.

5. A method for accepting genuine non-tubed coins in a vending machine, wherein the vending machine contains at least one coin tube for making change, comprising:

setting an overpay amount;

calculating a change value equal to the sum of a combination of coins available in the coin tubes that is closest to the value of an inserted non-tubed coin, without exceeding the value of the non-tubed coin; and accepting the non-tubed coin if the difference between the change value and the value of the non-tubed coin is less than or equal to the overpay amount.

6. The method of claim 5, wherein the step of setting an overpay amount further comprises:

generating a non-tube value equal to the lowest denomination acceptable non-tubed coin; and subtracting the non-tube value from the lowest value denomination of tubed coin.

7. The method of claim 5, further comprising:

permitting a vend to occur if the existing credit of all inserted coins is greater or equal to the price of a chosen item, and if a combination of coins exists in the coin tubes for making change that is less than or equal to the overpay amount.

8. A vending apparatus for accepting high-value non-tubed coins when exact change is not be available, comprising:

a vend item selector;

at least one coin validator;

at least one coin tube and sensor;

a change dispenser;

an item dispenser; and a controller connected to the item selector, the coin validator, the coin tube sensor, the change dispenser and the item dispenser, wherein the controller calculates an overpay amount, calculates a change value equal to the sum of the coins available in the coin tubes that is closest to the value of an inserted non-tubed coin without exceeding the value of the non-tubed coin, and accepts the non-tubed coin if the difference between the change value and the value of the non-tubed coin is not greater than the overpay amount.

9. The apparatus of claim 8, further comprising:

a display connected to the controller for indicating that lower denomination coins should be deposited first.

10. The apparatus of claim 8, further comprising:

a bill acceptor connected to the controller.

* * * * *

UNITED STATES PATENT AND TRADEMARK OFFICE

CERTIFICATE OF CORRECTION

PATENT NO. : 5,566,807
DATED : October 22, 1996
INVENTOR(S) : Mark J. Morun

It is certified that error appears in the above-identified patent and that said Letters Patent is hereby corrected as shown below:

Col. 13, line 44, (claim 2) cancel "the" and insert --a--.

Col. 13, line 55, (claim 4) cancel "overlay" and substitute --overpay--.

Col. 14, line 36, (claim 8) after "not", cancel "be".

Signed and Sealed this

Sixteenth Day of December, 1997

Bruce Lehman

*Attest:*

BRUCE LEHMAN

*Attesting Officer*

*Commissioner of Patents and Trademarks*